US007714826B2

(12) United States Patent
Jang et al.

(10) Patent No.: US 7,714,826 B2
(45) Date of Patent: May 11, 2010

(54) LIQUID CRYSTAL DISPLAY AND DRIVING METHOD THEREOF

(75) Inventors: Yong Ho Jang, Gyeonggi-do (KR); Soo Young Yoon, Gyeonggi-do (KR)

(73) Assignee: LG Display Co., Ltd., Seoul (KR)

( * ) Notice: Subject to any disclaimer, the term of this patent is extended or adjusted under 35 U.S.C. 154(b) by 938 days.

(21) Appl. No.: 11/010,443

(22) Filed: Dec. 14, 2004

(65) Prior Publication Data

US 2005/0134541 A1 Jun. 23, 2005

(30) Foreign Application Priority Data

Dec. 17, 2003 (KR) ..... 10-2003-0092693

(51) Int. Cl.
*G09G 3/36* (2006.01)

(52) U.S. Cl. ..... 345/98; 345/87; 345/95; 345/99; 345/100

(58) Field of Classification Search ..... 345/95, 345/87, 98–100
See application file for complete search history.

(56) References Cited

U.S. PATENT DOCUMENTS 6,700,562 B1 * 3/2004 Knapp et al. ..... 345/98
7,027,028 B2 * 4/2006 Ishii ..... 345/98
7,038,644 B2 * 5/2006 Kim et al. ..... 345/87
7,126,573 B2 * 10/2006 Park et al. ..... 345/94
7,167,169 B2 * 1/2007 Libsch et al. ..... 345/211
7,212,183 B2 * 5/2007 Tobita ..... 345/93

FOREIGN PATENT DOCUMENTS

CN 1447297 10/2003
JP 2000-181394 * 6/2000

OTHER PUBLICATIONS

English translation (machine) of Japanese Patent Application No. JP2000-181394 with named inventor Sunao ("Sunao") and abstract and drawings for same from the Industrial Property Digital Library, web address: http://www4.ipdl.inpit.go.jp/Tokujitu/tjsogodben.ipdl?N0000=115 29 pages total.*

* cited by examiner

*Primary Examiner*—Amare Mengistu
*Assistant Examiner*—Robert R Rainey
(74) *Attorney, Agent, or Firm*—Morgan Lewis & Bockius LLP

(57) ABSTRACT

A liquid crystal display (LCD) device includes an LCD panel having a plurality of data lines and a plurality of gate lines crossing the data lines, a data driving circuit to generate a data voltage, a demultiplexer to apply the data voltage from the data driving circuit to the data lines using a plurality of switching devices, and a control signal generator to generate a plurality of control signals having a first polarity of voltage in order to turn on the switching devices and in order to add a second polarity of voltage to the control signals.

13 Claims, 14 Drawing Sheets

LIQUID CRYSTAL DISPLAY AND DRIVING METHOD THEREOF

This application claims the benefit of Korean Patent Application No. P2003-92693 filed in Korea on Dec. 17, 2003, which is hereby incorporated by reference.

BACKGROUND OF THE INVENTION

1. Field of the Invention

The present invention relates to a liquid crystal display (LCD), and more particularly, to a demultiplexer for an LCD and a driving method thereof.

2. Discussion of the Related Art

In general, an LCD controls light transmittance of liquid crystals in accordance with a video signal so that a picture corresponding to the video signal can be displayed on the LCD. The LCD includes an LCD panel having liquid crystal cells arranged in an active matrix type, and driving circuits for driving the LCD panel. In the LCD panel, a plurality of data lines and a plurality of gate lines are intersected, and pixel driving thin film transistors (TFTs) are provided at respective intersected portions. The driving circuits of the LCD include a data driving circuit for supplying a data to the data lines of the LCD panel, and a gate driving circuit for supplying a scanning pulse to the LCD panel. Further, the driving circuits may include a demultiplexer provided between the data driving circuit and the data lines to distribute outputs of the data driving circuit into the data lines. The demultiplexer reduces the number of the outputs of the data driving circuit to simplify the data driving circuit and reduce the number of data input terminals of the LCD panel.

FIG. 1 shows a related art active matrix LCD. As shown in FIG. 1, the related art active matrix LCD includes an LCD panel 13 having m data lines DL1-DLm and n gate lines GL1-GLn crossing each other and a pixel driving TFT 16 provided at each intersection, a demultiplexer 14 provided between a data driving circuit 11 and the data lines DL1-DLm, and a gate driving circuit 12 for sequentially supplying a scanning pulse to the gate lines GL1-GLn.

The pixel driving TFT 16 applies a data signal from each of the data lines DL1-DLm to a pixel electrode 15 of a liquid crystal cell in response to a scanning signal from each of the gate lines GL1-GLn. Herein, the pixel driving TFT 16 has a gate electrode connected to a corresponding one of the gate lines GL1-GLn, a source electrode connected to a corresponding one of the data lines DL1-DLm, and a drain electrode connected to the pixel electrode 15 of the liquid crystal cell.

The data driving circuit 11 converts digital video data into analog gamma voltages, and makes a data time division for one line to apply the voltages to m/3 source lines SL1-SLm/3. The mn/3 demultiplexers 14 are arranged parallel to each other between the data driving circuit 11 and the data lines DL1-DLm. Each of the demultiplexers 14 includes first through third TFTs (hereinafter referred to as "MUX TFT") MT1, MT2 and MT3. The first through third MUX TFTs MT1, MT2 and MT3 make a time division of data input over one signal line in response to different control signals Φ1, Φ2 and Φ3 to apply these control signals to three data lines. The gate driving circuit 12 sequentially applies scanning pulses to the gate lines GL1-GLn by using a shift register and a level shifter.

FIG. 2 shows control signals Φ1, Φ2 and Φ3 and scanning pulses SP of the demultiplexer 14. As shown in FIG. 2, the scanning pulse SP has a gate high voltage Vgh during approximately one horizontal period 1H while maintaining a gate low voltage Vgl during the remaining period. A duty ratio of the scanning pulse SP is approximately one by several hundreds because one frame interval includes hundreds of horizontal periods.

Each of the control signals Φ1, Φ2 and Φ3 has the gate high voltage Vgh during approximately ⅓ horizontal period every horizontal period. A duty ratio of each of the control signal Φ1, Φ2 and Φ3 is about ½ to 1 by several numbers because each control signal is generated every horizontal period. Herein, when a duty ratio of each control signal is ½, only two of the MUX TFTs are included in a single demultiplexer.

The MUX TFTs MT1, MT2 and MT3 and the pixel driving TFT 16 are directly and simultaneously provided on a glass substrate of the LCD panel 13, and have the same swing width between the gate high voltage Vgh and the gate low voltage Vgl. If the MUX TFTs MT1, MT2 and MT3 are supplied with gate voltages having the same polarity for a long time, that is, if they receive a positive gate bias stress or a negative gate bias stress, variation and deterioration of operation characteristics occur more easily. The variation and deterioration results from the MUX TFTs MT1, MT2 and MT3 having a longer gate voltage application time than the pixel driving TFT 16 as shown in FIG. 2. Particularly, if the MUX TFTs MT1, MT2 and MT3 are formed from amorphous silicon TFT, then the variation and deterioration of operation characteristics occur more easily against the positive gate bias stress or the negative gate bias stress because a semiconductor layer structure of the amorphous silicon TFT has more defects than those of polycrystalline silicon TFT (poly-Si TFT). The variation in operation characteristics of the MUX TFTs MT1, MT2 and MT3 can be seen from experimental results in FIGS. 3 and 4.

FIGS. 3 and 4 show experimental results indicating that a characteristic change of a sample hydride amorphous silicon (a-Si:H TFT) happened when a positive gate bias stress and a negative gate bias stress were applied to the sample a-Si:H TFT having a channel width/channel length W/L of 120 μm/6 μm, respectively. In FIGS. 3 and 4, the horizontal axis represents a gate voltage [V] of the sample a-Si:H TFT while the vertical axis represents a current [A] between the source terminal and the drain terminal of the sample a-Si:H TFT.

FIG. 3 shows a threshold voltage and a movement in a transfer characteristic curve of a TFT according to a voltage application time when a voltage of +30V is applied to a gate terminal of the sample a-Si:H TFT. In FIG. 3, as the time when a high positive voltage is applied to the gate terminal of the a-Si:H TFT becomes longer, the transfer characteristic curve of the TFT is moved more to the right side 31 and the threshold voltage of the a-Si:H TFT rises.

FIG. 4 shows a threshold voltage and a movement in a transfer characteristic curve of a TFT according to a voltage application time when a voltage of −30V is applied to the gate terminal of the sample a-Si:H TFT. In FIG. 4, as the time when a high negative voltage is applied to the gate terminal of the a-Si:H TFT becomes longer, the transfer characteristic curve of the TFT is moved more to the left side (41) and the threshold voltage of the a-Si:H TFT is lowered.

FIG. 5 shows an accumulation of gate voltage stresses undergone at each of the MUX TFTs MT1, MT2 and MT3. In FIG. 5, as the gate voltage stresses of the MUX TFTs MT1, MT2 and MT3 are accumulated whenever the same polarity of the control signals Φ1, Φ2 and Φ3 are applied thereto, a threshold voltage of each of the MUX TFTs MT1, MT2 and MT3 gradually rises or falls. As the threshold voltage of the MUX TFT rises or falls in this manner, an operation of the demultiplexer 14 becomes unstable, thereby causing difficulty to normally drive the LCD.

SUMMARY OF THE INVENTION

Accordingly, the present invention is directed to a liquid crystal display (LCD) and a method of driving the same that substantially obviates one or more of the problems due to limitations and disadvantages of the related art.

An object of the present invention is to provide an LCD and a method of driving the same that is capable of minimizing a characteristic variation and a deterioration in a switching device.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the LCD device includes an LCD panel having a plurality of data lines and a plurality of gate lines crossing the data lines, a data driving circuit to generate a data voltage, a demultiplexer to apply the data voltage from the data driving circuit to the data lines using a plurality of switching devices, and a control signal generator to generate a plurality of control signals having a first polarity of voltage in order to turn on the switching devices and in order to add a second polarity of voltage to the control signals.

In another aspect, the method of driving a demultiplexer for a liquid crystal display (LCD) includes generating control signals for the demultiplexer connected between a data driving circuit for generating a data voltage and data lines of an LCD panel, each of the control signals having a first polarity of voltage and a second polarity of voltage; turning on switching devices in the demultiplexter by using the first polarity of voltage; and restoring a stress of the switching devices by using the second polarity of voltage.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE PREFERRED EMBODIMENT

Reference will now be made in detail to the preferred embodiments of the present invention, examples of which are illustrated in the accompanying drawings. Hereinafter, the preferred embodiments of the present invention will be described in detail with reference to FIGS. 6 to 13.

Figure 6:
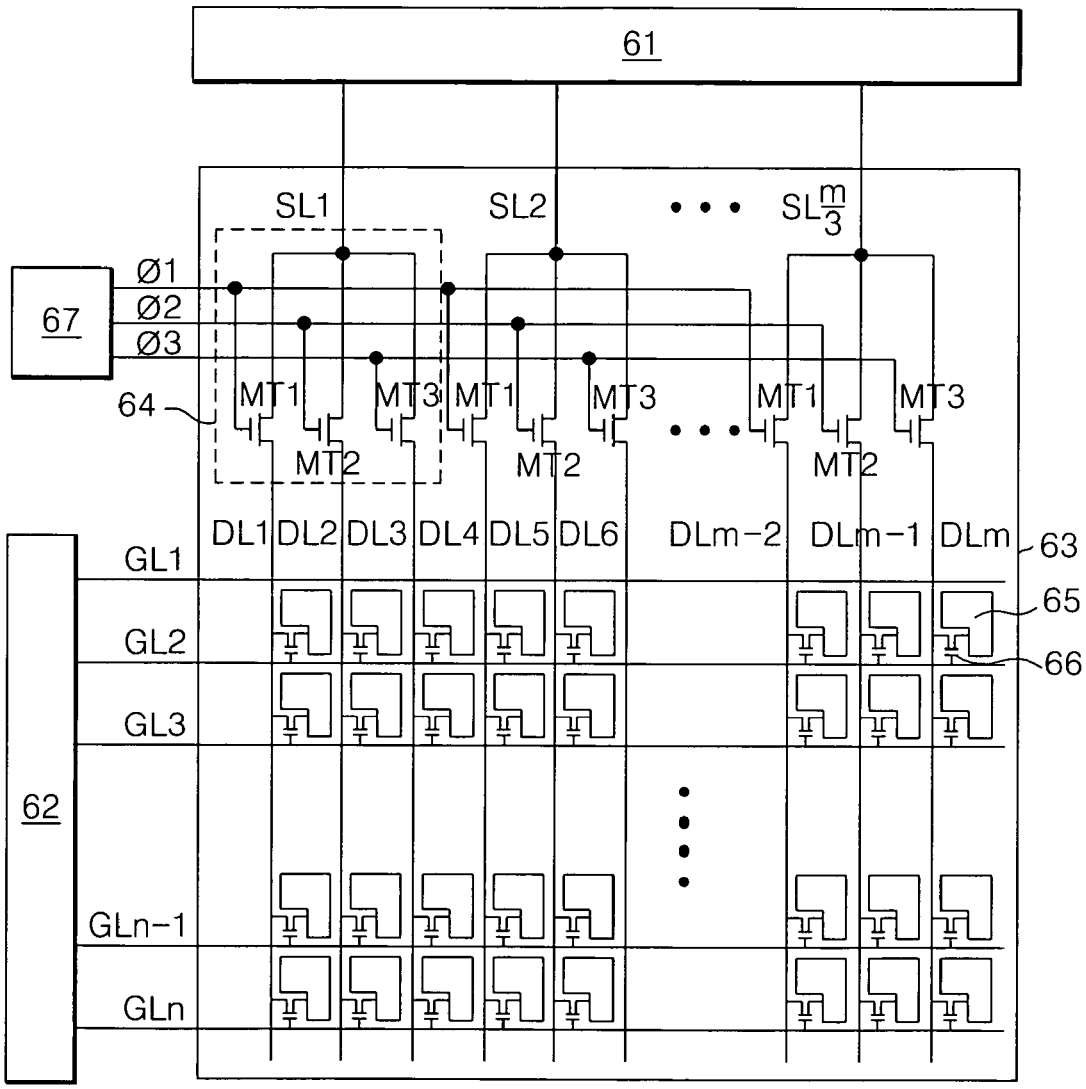
FIG. 6 is a block circuit diagram showing a configuration of an LCD according to an exemplary embodiment of the present invention.

FIG. 6 schematically shows a liquid crystal display (LCD) according to an exemplary embodiment of the present invention. As shown in FIG. 6, the LCD includes an LCD panel 63 having m data lines DL1-DLm and n gate lines GL1-GLn crossing each other and a plurality of pixel driving TFTs 66 provided at crossing portions thereof, a demultiplexer 64 having MUX TFTs MT1, MT2 and MT3 provided between a data driving circuit 61 and the data lines DL1-DLm and implemented by a n-type amorphous silicon TFT, a control signal generator 67 for generating stress compensating control signals CΦ1, CΦ2 and CΦ3, and a gate driving circuit 62 for sequentially supplying scanning pulses to the gate lines GL1-GLn.

The data driving circuit 61 converts digital video data into analog gamma compensating voltages, and makes a time division of data for one line to apply the voltages to m/3 source lines SL1-SLm/3. The m/3 demultiplexers 64 are arranged parallel to each other between the data driving circuit 61 and the data lines DL1-DLm. Each of the demultiplexer 64 includes first through third MUX TFTs MT1, MT2 and MT3 for distributing a data voltage supplied from a single source line into three data lines. The first through third MUX TFTs MT1, MT2 and MT3 make a time division of data input over a single source line in response to positive voltages of different stress compensating control signals CΦ1, CΦ2 and CΦ3 to apply them to three data lines. Further, the first through third MUX TFTs MT1, MT2 and MT3 cancel a stress according to an accumulation of positive gate voltages by negative voltages of the stress compensating control signals CΦ1, CΦ2 and CΦ3, thereby keeping a threshold voltage constant and an operation characteristic of the demultiplexer 64 stable.

As shown in FIG. 6, the number of the MUX TFTs in the demultiplexer 64 and the number of output channels of the demultiplexer 64 should be three. However, they are not limited to this, but may be selectively adjusted. If the number of the MUX TFTs in the demultiplexer 64 and the number of the output channels of the demultiplexer 64 are i (wherein i is an integer), then the number of the source lines is reduced to m/i.

Figure 7:
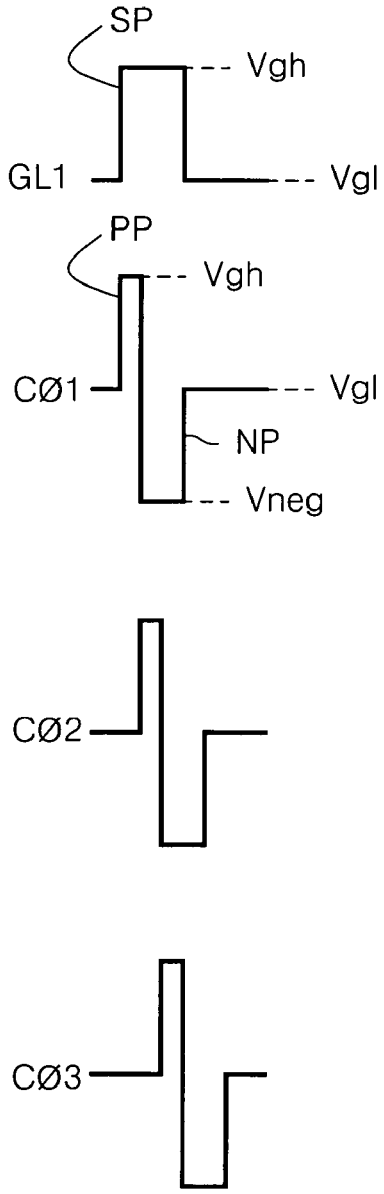
FIG. 7 is a waveform diagram of control signal and a scanning pulse for the demultiplexer shown in FIG. 6.

The control signal generator 67 generates the stress compensating control signals CΦ1, CΦ2 and CΦ3 for controlling the MUX TFTs MT1, MT2 and MT3 in the demultiplexer 64. The stress compensating control signals CΦ1, CΦ2 and CΦ3 have a positive gate high voltage Vgh for turning on the MUX TFTs MT1, MT2 and MT3 and thereafter have a negative voltage Vneg for compensating a positive stress as shown in FIG. 7. The negative voltage Vneg is a lower voltage than a gate low voltage Vgl. The gate driving circuit 62 sequentially applies the scanning pulses SP to the gate lines GL1-GLn swung between the gate high voltage Vgh and the gate low voltage Vgl as shown in FIG. 7 using a shift register and a level shifter (not shown).

FIG. 7 shows a scanning pulse SP applied to the first gate line GL1 and the stress compensating control signals CΦ1, CΦ2 and CΦ3 applied to the gate terminals of the first through third MUX TFTs MT1, MT2 and MT3. As shown in FIG. 7, the scanning pulse SP has a gate high voltage Vgh during approximately one horizontal period 1H while maintaining a gate low voltage Vgl during the remaining period. Each of the stress compensating control signal CΦ1, CΦ2 and CΦ3 includes a positive pulse PP having a positive gate high voltage Vgh, and a negative pulse NP having a negative voltage Vneg that follows the positive pulse PP. The positive pulses PP of the stress compensating control signals CΦ1, CΦ2 and CΦ3 turn on the first through third MUX TFTs MT1, MT2 and MT3 while the negative pulses NP of the stress compensating control signals CΦ1, CΦ2 and CΦ3 compensate for positive gate bias stresses of the first through third MUX TFTs MT1, MT2 and MT3.

An operation of the demultiplexer 64 will be described below with reference to FIGS. 6 and 7. The positive pulse PP of the first stress compensating control signal CΦ1 is generated at approximately ⅓ width of the scanning pulse SP simultaneously with the scanning pulse SP, thereby turning on the first MUX TFT MT1. Then, a data voltage of the first source line SL1 is applied to the first data line DL1. The negative pulse NP of the first stress compensating control signal CΦ1 applies a negative voltage Vneg to the gate terminal of the first MUX TFT MT1 after the first MUX TFT MT1 is turned on in response to the positive gate high voltage Vgh.

The positive pulse PP of the second stress compensating control signal CΦ2 is generated at approximately ⅓ width of the scanning pulse SP just after the positive pulse PP of the first stress compensating control signal CΦ1, thereby turning on the second MUX TFT MT2. Then, a data voltage of the first source line SL1 is applied to the second data line DL2. The negative pulse NP of the second stress compensating signal CΦ2 applies a negative voltage Vneg to the gate terminal of the second MUX TFT MT2 after the second MUX TFT MT2 is turned on in response to the positive gate high voltage Vgh.

The positive pulse PP of the third stress compensating signal CΦ3 is generated at approximately ⅓ width of the scanning pulse SP just after the positive pulse PP of the second stress compensating control signal CΦ2, thereby turning on the third MUX TFT MT3. Then, a data voltage of the first source line SL1 is applied to the third data line DL3. The negative pulse NP of the third stress compensating signal CΦ3 applies a negative voltage Vneg to the gate terminal of the third MUX TFT MT3 after the third MUX TFT MT3 is turned on in response to the positive gate high voltage Vgh.

Partial intervals of the negative pulse NP of the first stress compensating control signal CΦ1 and the positive pulse PP of the second stress compensating control signal CΦ2 overlap with each other, whereas partial intervals of the negative pulse NP of the second stress compensating control pulse CΦ2 and the positive pulse PP of the third stress compensating control signal CΦ3 overlap with each other.

Figure 8:
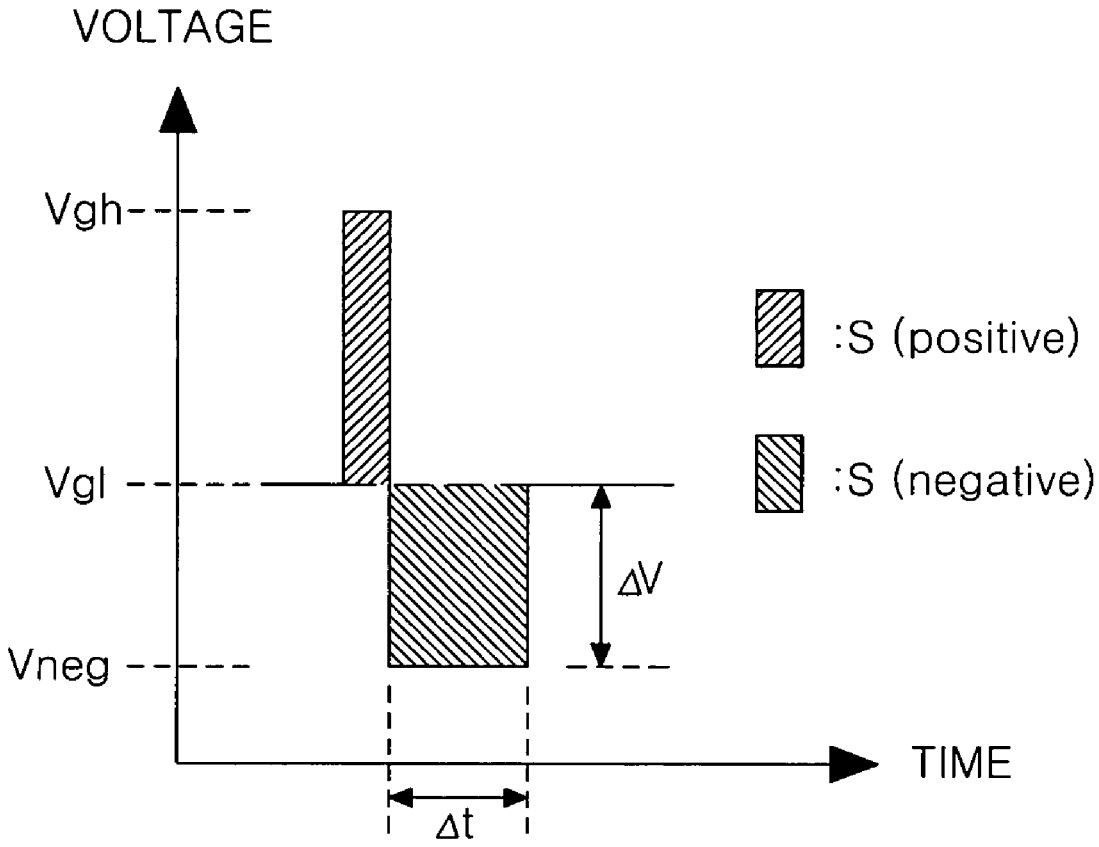
FIG. 8 is a graph representing a positive stress amount according to a positive voltage of a control signal shown in FIG. 7 and a negative stress amount according to a negative voltage of the control signal by an area.

FIG. 8 represents a positive stress amount according to a positive voltage of a control signal shown in FIG. 7 and a negative stress amount according to a negative voltage of the control signal by an area. As shown in FIG. 8, the positive pulses PP of the stress compensating control signals CΦ1, CΦ2 and CΦ3 apply positive gate bias stresses to the MUX TFTs MT1, MT2 and MT3, whereas the negative pulse NP of the stress compensating control signals CΦ1, CΦ2 and CΦ3 apply negative gate bias stresses to the MUX TFTs MT1, MT2 and MT3. A negative stress amount S(negative) caused by the negative pulses PP of the stress compensating control signals CΦ1, CΦ2 and CΦ3 is "k" times as large as a positive stress amount S(positive) caused by the positive pulses PP of the stress compensating control signals CΦ1, CΦ2 and CΦ3. Each of the negative stress amount S(negative) and the positive stress amount S(positive) corresponds to an area of (voltage×time). Herein, "k" is a proportional coefficient having a positive value. Meanwhile, the negative pulses PP of the stress compensating control signals CΦ1, CΦ2 and CΦ3 may be a rectangular pulse, a ramp pulse, or other shaped pulses.

Figure 1:
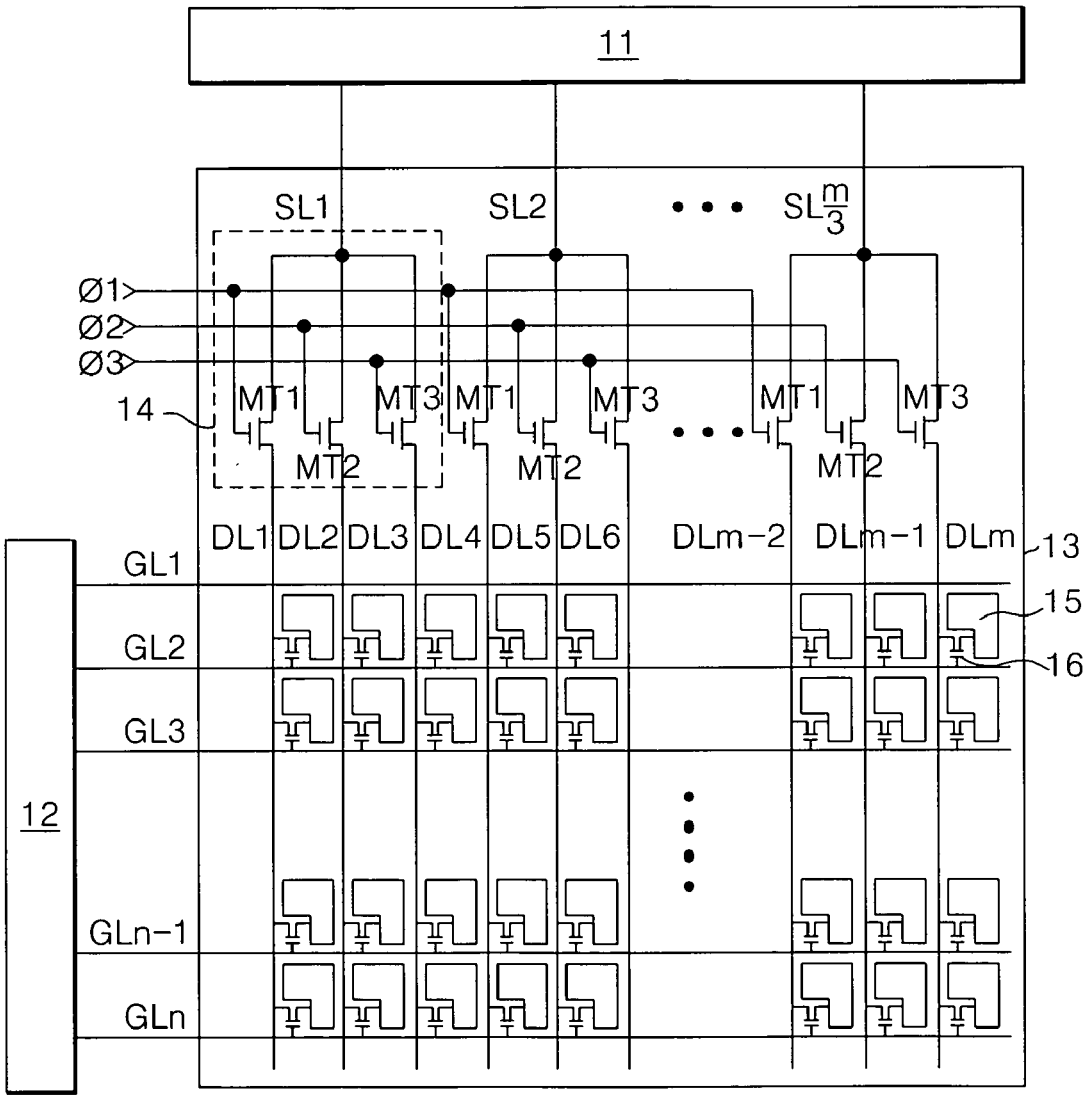
FIG. 1 RELATED ART
FIG. 1 is a block circuit diagram showing a configuration of a related art liquid crystal display (LCD)
Figure 2:
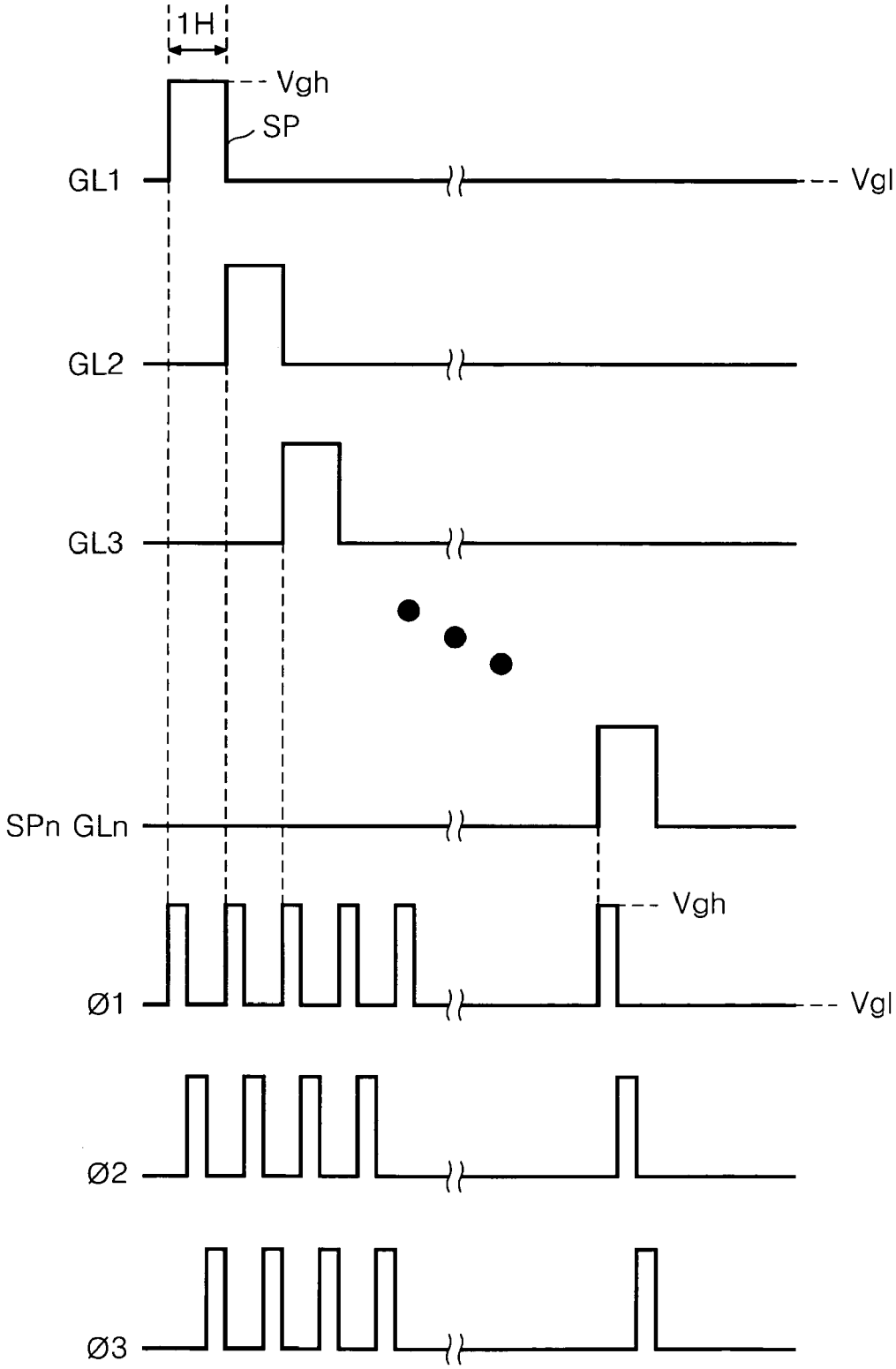
FIG.2 RELATED ART
FIG. 2 is a waveform diagram of signals applied to a demultiplexer shown in FIG. 1.
Figure 3:
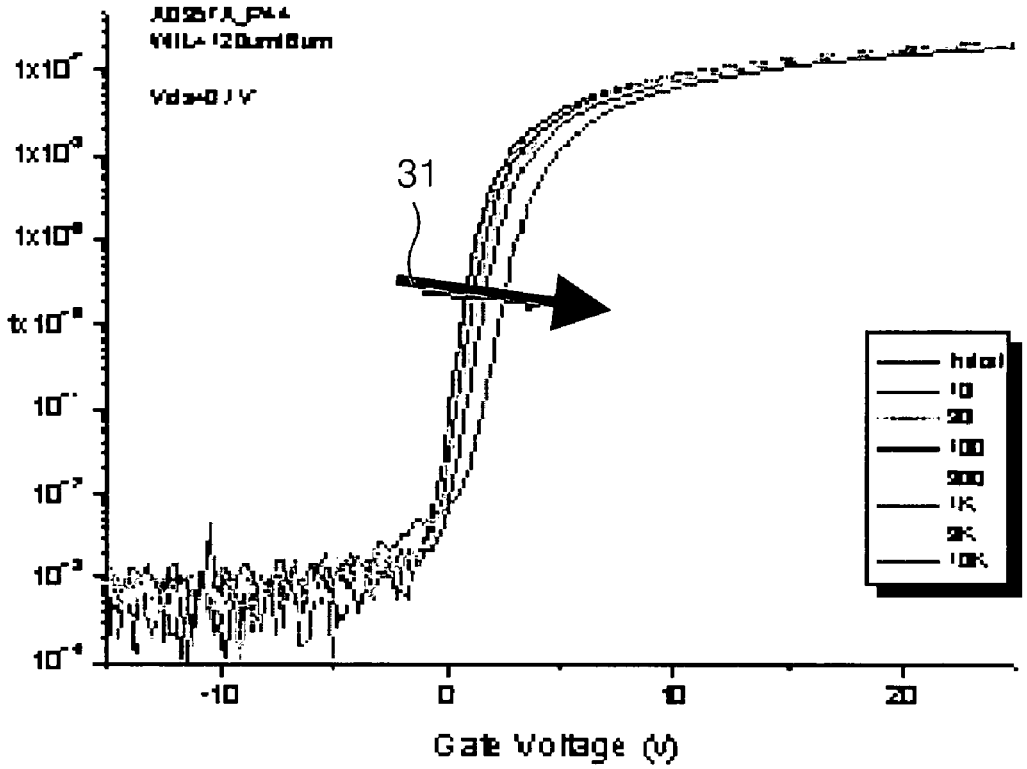
FIG.3 RELATED ART
FIG. 3 is a graph representing a threshold voltage and a movement of a transfer characteristic curve of a thin film transistor during a voltage application time when a positive voltage is applied to a gate terminal of a sample a-Si:H thin film transistor according to the related art LCD.
Figure 4:
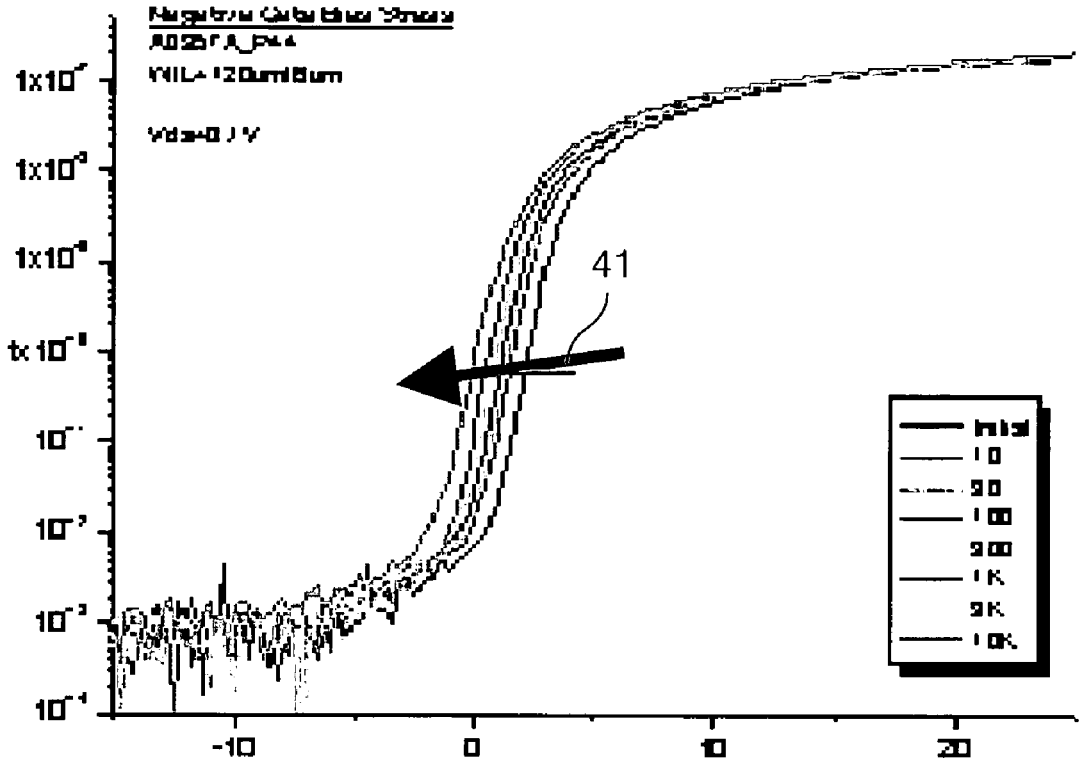
FIG. 4 RELATED ART
FIG. 4 is a graph representing a threshold voltage and a movement of a transfer characteristic curve of a thin film transistor during a voltage application time when a negative voltage is applied to the gate terminal of a sample a-Si:H thin film transistor according to the related art LCD.
Figure 5:
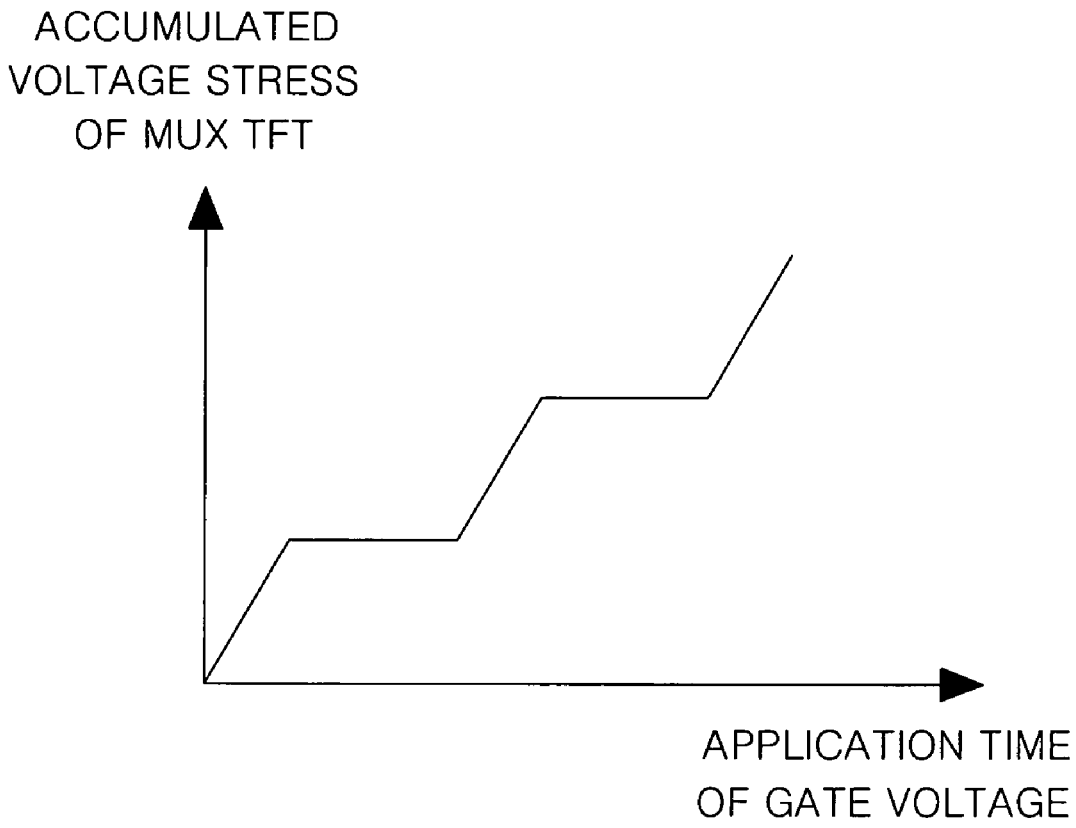
FIG.5 RELATED ART
FIG. 5 is a graph representing an accumulated stress amount applied to the transistor in the demultiplexer when the same gate voltage is repetitively applied thereto according to the related art LCD.

If a data voltage corresponding to a source voltage of each of the MUX TFTs MT1, MT2 and MT3 goes close to the gate low voltage Vgl, then the proportional coefficient "k" must be larger than 1. Since most of data voltages are generally higher than the gate low voltage Vgl, the proportional coefficient k has a value satisfying a condition of "$0 \leqq k \leqq 10$." On the other hand, the related art control signals Φ1, Φ2 and Φ3 as shown in FIG. 2 can apply positive gate bias stresses to the MUX TFTs MT1, MT2 and MT3, but cannot apply negative gate bias stresses capable of canceling the positive gate bias stresses. In other words, in the related art control signals Φ1, Φ2 and Φ3, the negative stress amount S(negative) of the MUX TFTs MT1, MT2 and MT3 is '0'.

Figure 9A:
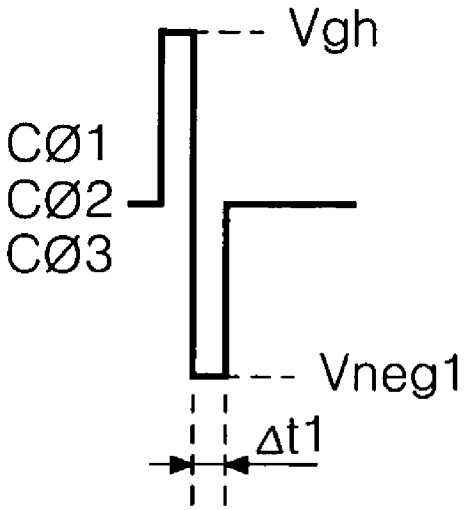
FIGS. 9A and 9B are waveform diagrams of control signals in which an application time or a voltage level of a negative voltage is different from the control signals shown in FIG. 7.
Figure 9B:
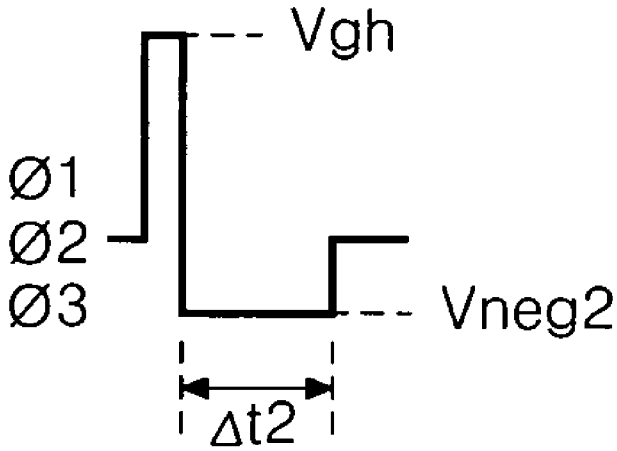

The negative pulses PP of the stress compensating control signals CΦ1, CΦ2 and CΦ3 have a voltage ΔV or a time Δt differentiated within a condition that the negative stress amount S(negative) is "k" times as large as the positive stress amount caused by the positive pulses PP of the stress compensating control signals CΦ1, CΦ2 and CΦ3 (wherein "$0 \leqq k \leqq 10$"). For instance, as shown in FIG. 9A, the negative voltage Vneg may be changed into a lower negative voltage Vneg1, whereas an application time Δt of the negative voltage Vneg may be changed into a shorter time Δt1. Further, as shown in FIG. 9B, the negative voltage Vneg may be changed into a higher negative voltage Vneg2, whereas an application time Δt of the negative voltage Vneg may be changed into a longer time Δt2.

Figure 10:
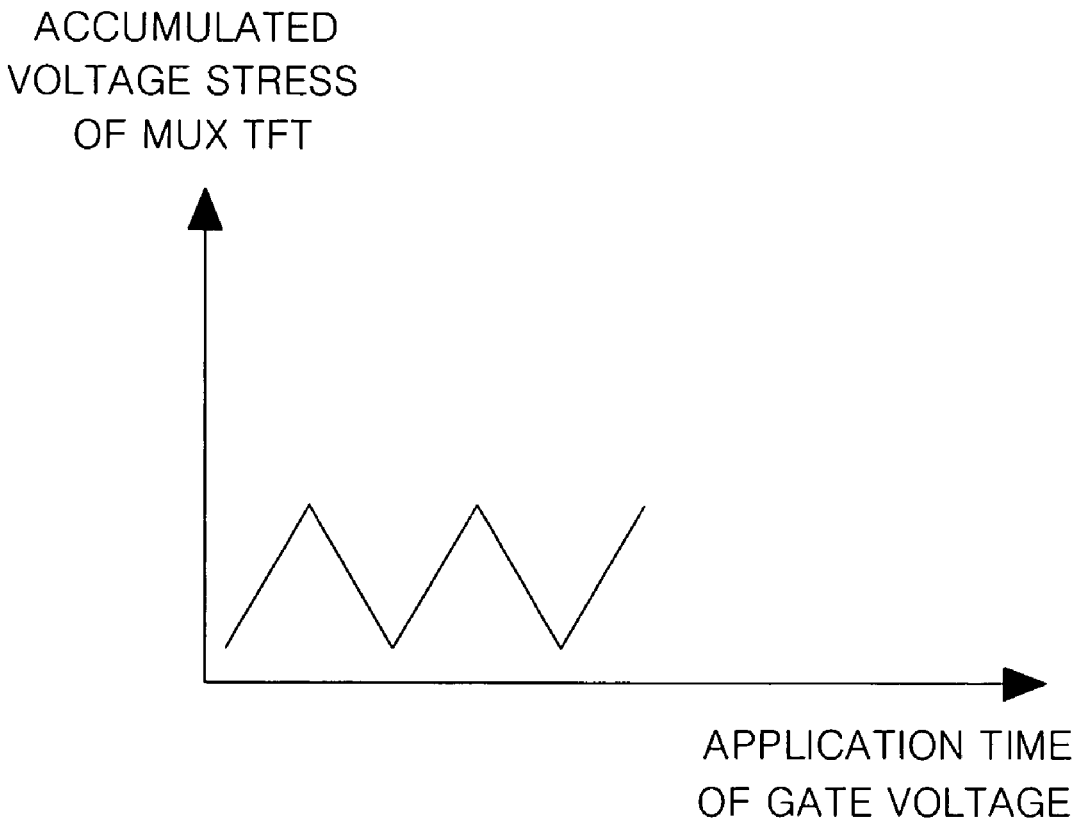
FIG. 10 is a graph showing that stresses are not accumulated continuously to a transistor of the demultiplexer by the negative voltage of the control signals in FIGS. 7-9B.

FIG. 10 shows an accumulation of gate voltage stresses undergone at the MUX TFTs MT1, MT2 and MT3. As shown in FIG. 10, the MUX TFTs MT1, MT2 and MT3 do not have any gate voltage stresses because polarities of the stress compensating control signals CΦ1, CΦ2 and CΦ3 are periodically inverted. Accordingly, a threshold voltage is kept constant and an operation characteristic of each of the MUX TFTs MT1, MT2 and MT3 are not deteriorated.

Figure 11:
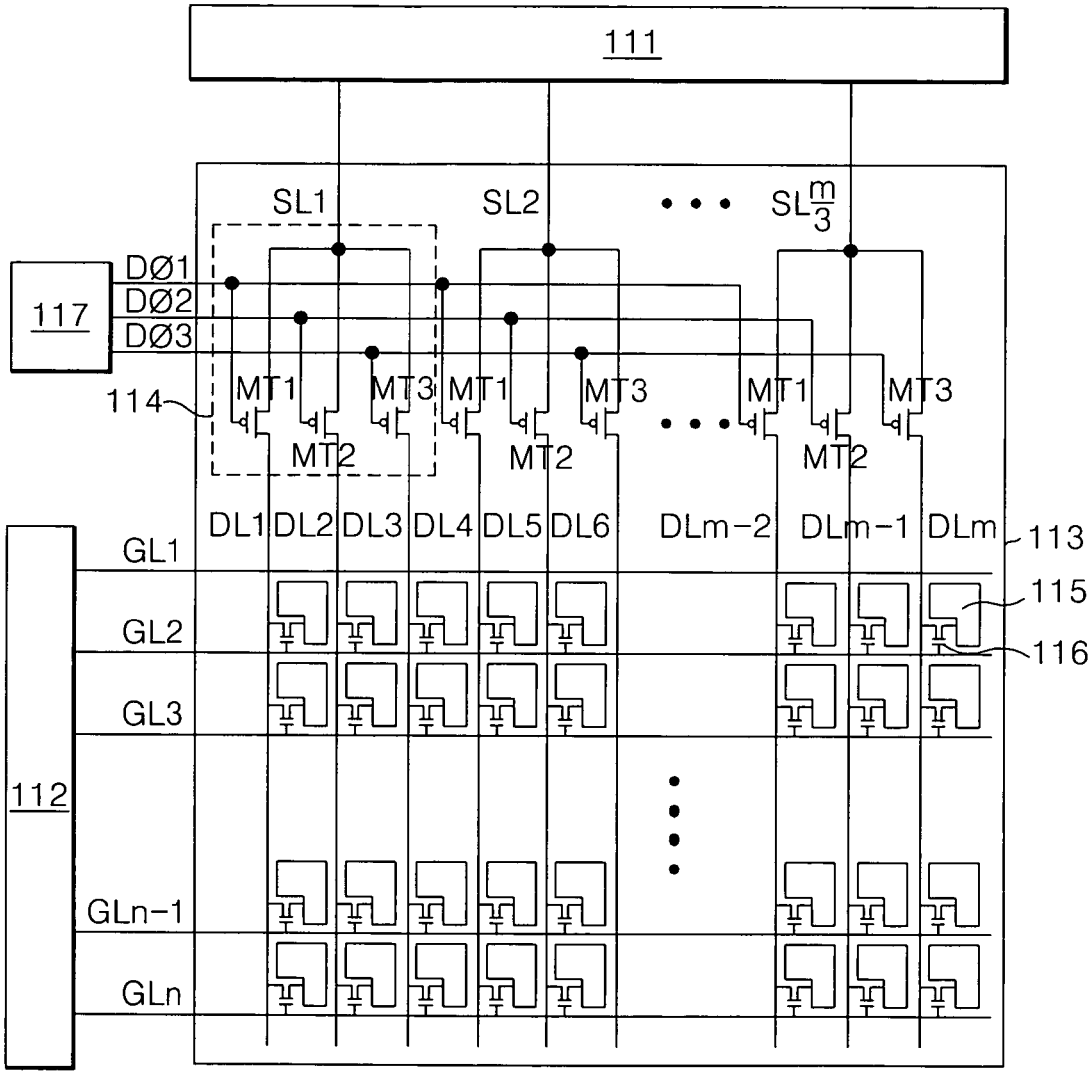
FIG. 11 is a block circuit diagram showing a configuration of an LCD according to another exemplary embodiment of the present invention.
Figure 12:
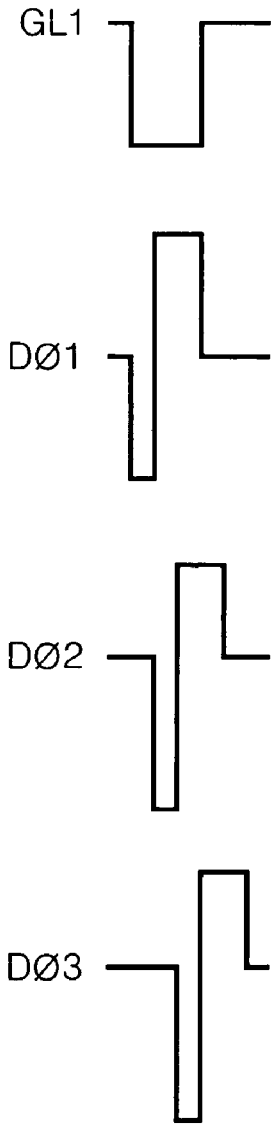
FIG. 12 is a waveform diagram of a control signal and a scanning pulse for the demultiplexer shown in FIG. 11.
Figure 13:
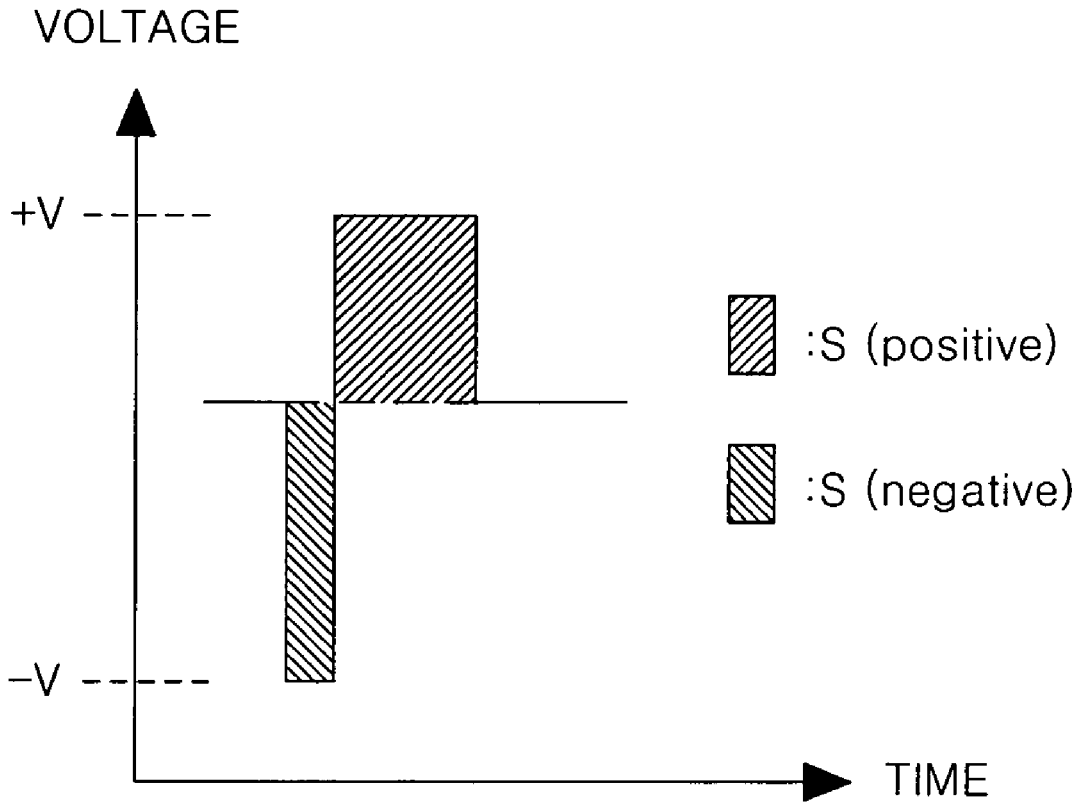
FIG. 13 is a graph representing a positive stress amount according to a positive voltage of the control signal shown in FIG. 12 and a negative stress amount according to a negative voltage of the control signal by an area.

FIGS. 11-13 show an LCD according to another exemplary embodiment of the present invention. As shown in FIG. 11, the LCD includes an LCD panel 113 having m data lines DL1-DLm and n gate lines GL1-GLn crossing each other and a plurality of pixel driving TFTs 116 provided at respective crossing portions, a demultiplexer 114 having MUX TFTs MT1, MT2 and MT3 provided between a data driving circuit 111 and the data lines DL1-DLm and implemented by a p-type polycrystalline silicon TFT, a control signal generator 117 for generating stress compensating control signals DΦ1, DΦ2 and DΦ3, and a gate driving circuit 112 for sequentially supplying scanning pulses to the gate lines GL1-GLn.

The data driving circuit 111 converts digital video data into analog gamma compensating voltages, and makes a time division of data for one line to apply the voltages to m/3 source lines SL1-SLm/3. The m/3 demultiplexers 114 are arranged parallel to each other between the data driving circuit 111 and the data lines DL1-DLm. Each of the demultiplexer 114 includes first through third MUX TFTs MT1, MT2 and MT3 for distributing a data voltage supplied from a single source line into three data lines. The first through third MUX TFTs MT1, MT2 and MT3 make a time division of data input over a single source line in response to negative voltages of different stress compensating control signals DΦ1, DΦ2 and DΦ3 to apply them to three data lines. Further, the first through third MUX TFTs MT1, MT2 and MT3 cancel a stress caused according to an accumulation of negative gate voltages by positive voltages of the stress compensating control signals DΦ1, DΦ2 and DΦ3, thereby keeping a threshold voltage constant and an operation characteristic of the demultiplexer 114 stable.

The control signal generator 117 generates the stress compensating control signals DΦ1, DΦ2 and DΦ3 for controlling the MUX TFTs MT1, MT2 and MT3 in the demultiplexer 114. The stress compensating control signals DΦ1, DΦ2 and DΦ3 have a negative voltage −V for turning on the MUX TFTs MT1, MT2 and MT3 and thereafter have a positive voltage +V for compensating a negative stress as shown in FIG. 12.

The gate driving circuit 112 sequentially applies scanning pulses SP to the gate lines GL1-GLn swung between the gate high voltage Vgh and the gate low voltage Vgl as shown in FIG. 12 using a shift register and a level shifter (not shown).

FIG. 12 shows a scanning pulse SP1 applied to the first gate line GL1 and the stress compensating control signals DΦ1, DΦ2 and DΦ3 applied to the gate terminals of the first through third MUX TFTs MT1, MT2 and MT3. As shown in FIG. 12, if the pixel driving TFT is implemented by a p-type transistor like the MUX TFTs MT1, MT2 and MT3, then the scanning pulse SP has a gate low voltage Vgl during approximately one horizontal period 1H while maintaining a gate high voltage Vgh during the remaining period.

Each of the stress compensating control signal DΦ1, DΦ2 and DΦ3 includes a negative pulse having a negative voltage −V, and a positive pulse having a positive voltage +V that follows the negative pulse. The negative pulses of the stress compensating control signals DΦ1, DΦ2 and DΦ3 turn on the first through third MUX TFTs MT1, MT2 and MT3 while the positive pulses of the stress compensating signals DΦ1, DΦ2 and DΦ3 compensate for negative gate bias stresses of the first through third MUX TFTs MT1, MT2 and MT3.

FIG. 13 represents a positive stress amount and a negative stress amount applied to the MUX TFTs MT1, MT2 and MT3 of the demultiplexer 114 by the stress compensating control signals DΦ1, DΦ2 and DΦ3 by an area. As shown in FIG. 13, the negative pulses of the stress compensating control signals DΦ1, DΦ2 and DΦ3 apply negative gate bias stresses to the MUX TFTs MT1, MT2 and MT3 while the positive pulse of the stress compensating control signals DΦ1, DΦ2 and DΦ3 apply positive gate bias stresses to the MUX TFTs MT1, MT2 and MT3. A positive stress amount S(positive) caused by the positive pulses of the stress compensating control signals DΦ1, DΦ2 and DΦ3 is "k" times as large as a negative stress amount S(negative) caused by the negative pulses of the stress compensating control signals DΦ1, DΦ2 and DΦ3". Herein, "k" is a proportional coefficient having a positive value satisfies a condition of "$0 \leqq k \leqq 10$."

In addition, the positive pulses of the stress compensating control signals DΦ1, DΦ2 and DΦ3 may have a voltage ΔV or a time Δt differentiated within this condition. Meanwhile, the positive pulses of the stress compensating control signals DΦD, DΦ2 and DΦ3 may be a rectangular pulse or a ramp pulse, or other shaped pulses. Alternatively, switching devices, that is, the MUX TFTs MT1, MT2 and MT3 of the demultiplexers 64 and 114 according to the exemplary preferred embodiments, may be implemented by amorphous silicon or crystalline silicon.

As described above, according to the present invention, the demultiplexer is provided between the data driving circuit and the data lines, thereby simplifying the number of signal wires and the circuit configuration. Further, an inverse polarity of pulse is added to the control signal for controlling each MUX TFT, thereby minimizing a characteristic variation and a deterioration in the MUX TFT resulted from the gate bias stress caused by an application of the same polarity of gate voltages to the gate terminals of the MUX TFTs.

It will be apparent to those skilled in the art that various modifications and variations can be made in the LCD and the method of driving the same of the present invention without departing from the spirit or scope of the invention. Thus, it is intended that the present invention cover the modifications and variations of this invention provided they come within the scope of the appended claims and their equivalents.

What is claimed is:

1. A liquid crystal display (LCD) device, comprising:

an LCD panel having a plurality of data lines, and a plurality of gate lines crossing the data lines;

a gate driving circuit to sequentially supply scanning pulses to the plurality of gate lines;

a data driving circuit to generate a data voltage;

a demultiplexer to apply the data voltage from the data driving circuit to the plurality of data lines using a plurality of switching devices;

a control signal generator to generate a plurality of control signals having a first polarity of voltage in order to turn on the switching devices of the demultiplexer and a second polarity of voltage in order to compensate a positive stress caused by the first polarity of voltage, wherein the positive stress is to be happened to the switching devices of the demultiplexer by the first polarity of voltage, wherein the first polarity of voltage is a positive voltage whereas the second polarity of voltage is a negative voltage and wherein the negative voltage is a lower voltage than a gate low voltage (Vgl) of the scanning pulses, and wherein a negative stress amount caused by the second polarity of voltage is "k" times as large as a positive stress amount caused by the first polarity of voltage, wherein "k" satisfies a condition of "$0<k \leqq 10$", wherein "k" must be larger than 1 if the data voltage goes close to the gate low voltage.

2. The LCD device according to claim 1, wherein the plurality of switching devices include amorphous silicon transistors.

3. The LCD device according to claim 2, wherein at least any one of a voltage application time and a voltage level in the first polarity of voltage is different from that in the second polarity of voltage.

4. The LCD device according to claim 2, wherein the plurality of data lines includes a first data line, a second data line and a third data line, and the plurality of switching devices include:

a first switching device connected between the data driving circuit and the first data line to apply a voltage from the data driving circuit to the first data line in response to the first polarity of voltage;

a second switching device connected between the data driving circuit and the second data line to apply the voltage from the data driving circuit to the second data line in response to the first polarity of voltage; and a third switching device connected between the data driving circuit and the third data line to apply the voltage from the data driving circuit to the third data line in response to the first polarity of voltage.

5. The LCD device according to claim 4, wherein the control signals include:

a first control signal to control the first switching device;

a second control signal to control the second switching device; and a third control signal to control the third switching device, wherein phases of the first through third control signals are different from each other.

6. The LCD device according to claim 5, wherein the second polarity of voltage of the first control signal overlaps with at least portion of the first polarity of voltage of the second control signal, and the second polarity of voltage of the second control signal overlaps with at least portion of the first polarity of voltage of the third control signal.

7. The LCD device according to claim 1, wherein the plurality of switching devices include n-type transistors.

8. The LCD device according to claim 1, wherein the first polarity of voltage is followed by the second polarity of voltage.

9. A method of driving a demultiplexer for a liquid crystal display (LCD), comprising:

generating control signals for the demultiplexer connected between a data driving circuit for generating a data voltage and a plurality of data lines of an LCD panel, each of the control signals having a first polarity of voltage and a second polarity of voltage;

turning on switching devices in the demultiplexer by using the first polarity of voltage; and restoring a positive stress of the switching devices by using the second polarity of voltage, wherein the positive stress is to be happened to the switching devices of the demultiplexer by the first polarity of voltage, wherein the first polarity of voltage is followed by the second polarity of voltage, wherein at least any one of a voltage application time and a voltage level in the first polarity of voltage is different from that in the second polarity of voltage, wherein the voltage level in the second polarity of voltage is a lower voltage than that of a gate low voltage (Vgl), and wherein a negative stress amount caused by the second polarity of voltage is "k" times as large as a positive stress amount caused by the first polarity of voltage, wherein "k" satisfies a condition of "$0<k\leqq 10$", wherein "k" must be larger than 1 if the data voltage goes close to the gate low voltage.

10. The method according to claim 9, wherein the generating the control signals includes:

generating a first control signal to control a first one of the switching devices connected between the data driving circuit and a first one of the data lines;

generating a second control signal to control a second one of the switching devices connected between the data driving circuit and a second one of the data lines; and generating a third control signal to control a third one of the switching devices connected between the data driving circuit and a third one of the data lines.

11. The method according to claim 10, wherein the second polarity of voltage of the first control signal overlaps with at least portion of the first polarity of voltage of the second control signal, and the second polarity of voltage of the second control signal overlaps with at least portion of the first polarity of voltage of the third control signal.

12. The method according to claim 9, wherein the switching devices include n-type transistors.

13. The method according to claim 9, wherein the first polarity of voltage is a positive voltage whereas the second polarity of voltage is a negative voltage.

* * * * *